US006562769B1

(12) United States Patent
Paatz et al.

(10) Patent No.: US 6,562,769 B1
(45) Date of Patent: May 13, 2003

(54) METHOD FOR PRODUCING AROMATIC BEADS

(75) Inventors: Kathleen Paatz, Duesseldorf (DE); Wolfgang Lahn, Willich (DE); Wilfried Raehse, Duesseldorf (DE); Kathrin Schnepp-Hentrich, Duesseldorf (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 0 days.

(21) Appl. No.: 09/529,862

(22) PCT Filed: Oct. 14, 1998

(86) PCT No.: PCT/EP98/06514

§ 371 (c)(1),
(2), (4) Date: Jun. 28, 2000

(87) PCT Pub. No.: WO99/21953

PCT Pub. Date: May 6, 1999

(30) Foreign Application Priority Data

Oct. 23, 1997 (DE) ..... 197 46 780

(51) Int. Cl.[7] ..... C11D 3/50; C11D 11/00; C11D 17/00

(52) U.S. Cl. ..... 510/101; 510/446

(58) Field of Search ..... 510/101, 446

(56) References Cited

U.S. PATENT DOCUMENTS

| | | | | |
|---|---|---|---|---|
| 3,966,629 | A | 6/1976 | Dumbrell | 252/140 |
| 4,667,839 | A | 5/1987 | Crisci | 215/256 |
| 4,737,306 | A | 4/1988 | Wichelhaus et al. | 252/95 |
| 4,820,439 | A | 4/1989 | Rieck | 252/135 |
| 5,780,420 | A | 7/1998 | Breuer et al. | 510/466 |

FOREIGN PATENT DOCUMENTS

| | | | | |
|---|---|---|---|---|
| CA | 981 141 | | 1/1976 | |
| DE | 23 34 899 | | 1/1974 | |
| DE | 35 26 405 | | 2/1987 | |
| DE | 38 16 842 | | 11/1989 | |
| DE | 39 11 363 | | 10/1990 | |
| DE | 41 33 862 | | 4/1993 | |
| DE | 44 00 024 | | 7/1995 | |
| DE | 195 30 999 | | 2/1997 | |
| DE | 197 35 783.0 | | 2/1999 | |
| EP | 0 028 432 | | 1/1981 | |
| EP | 0036720 | * | 9/1981 | 3/50 |
| EP | 0 062 523 | | 10/1982 | |
| EP | 0 164 514 | | 12/1985 | |
| EP | 0 167 210 | | 1/1986 | |
| EP | 0 325 457 | | 7/1989 | |
| EP | 0325457 | * | 7/1989 | 3/50 |
| EP | 0 026 529 | | 4/1992 | |
| EP | 0 679 715 | | 11/1995 | |
| WO | WO90/04960 | | 5/1990 | |
| WO | WO94/25563 | | 11/1994 | |
| WO | WO97/29176 | | 8/1997 | |
| WO | 97/29176 | * | 8/1997 | 3/50 |
| WO | WO97/29177 | | 8/1997 | |
| WO | WO98/12298 | | 3/1998 | |

OTHER PUBLICATIONS

Questel Patent Abstract (WPAT) No. 1993–127099 [16].
Questel Patent Abstract (WPAT) No. 1990–306580 [41].
Questel Patent Abstract (WPAT) No. 1999–154827 [14].
Questel Patent Abstract (WPAT) No. 1997–146497 [14].
Questel Patent Abstract (WPAT) No. 1985–270605 [44].
Questel Patent Abstract (WPAT) No. 1995–247054 [33].
Questel Patent Abstract (WPAT) No. 1974–07675V [05].
Questel Patent Abstract (WPAT) No. 1987–023182 [04].
Questel Patent Abstract (WPAT) No. 1989–349155 [48].

* cited by examiner

*Primary Examiner*—Yogendra N. Gupta
*Assistant Examiner*—Eisa Elhilo
(74) *Attorney, Agent, or Firm*—Stephen D. Harper; Glenn E. J. Murphy

(57) ABSTRACT

The invention relates to a method for producing aromatic shaped bodies, especially aromatic beads, with bulk densities greater than 700 g/l, whereby a solid and essentially water-free premix comprised of a) 65 to 95 wt. % carrier(s), b) 0 to 10 wt. % auxiliary agent(s), and c) 5 to 25 wt. % perfume is subjected to granulation or compacted agglomeration. In addition, the invention relates to the application of the inventive aromatic shaped bodies in order to scent washing and cleaning detergents, to washing and cleaning detergents containing shaped bodies which are produced according to the invention, and to a method for scenting textiles in a wash machine.

19 Claims, No Drawings

METHOD FOR PRODUCING AROMATIC BEADS

FIELD OF THE INVENTION

This invention relates to the production of perfume shaped bodies, more particularly perfume beads, which may be incorporated in detergents and laundry treatment and aftertreatment compositions and which provide the treated laundry with a perfume-enhancing effect. The present invention also relates to detergents containing the shaped bodies produced in accordance with the invention and to the use of the shaped bodies produced in accordance with the invention for perfuming wash liquors.

BACKGROUND OF THE INVENTION

In the washing, treatment and aftertreatment of laundry, it is now common practice to add small quantities of perfume to the detergents and aftertreatment compositions in order to provide the wash liquor itself and also the laundry treated with the wash liquor with a pleasant fragrance. In addition, besides color and appearance, the perfuming of detergents and aftertreatment compositions is an important aspect of the aesthetic product impression and an important factor in the consumer deciding for or against a certain product. For perfuming, the perfume may, either be directly incorporated in the detergent/composition or may be added to the wash liquor in an additional step. The first method determines a certain product characteristic whereas, in the second method, the consumer is able individually to chose his/her perfume from the various perfume variants on offer—comparable with the choice of an eau-de-toilette or an aftershave lotion.

Accordingly, perfume shaped bodies and processes for perfuming wash liquors are widely described in the prior art. Thus, DE 41 33 862 (Henkel) discloses tablets containing carrier materials, perfumes and optionally other typical detergent ingredients, sorbitol and in addition 20 to 70% by weight of an effervescent system of carbonate and acid being used as the carrier material. These tablets, which may be added for example in the after-rinse cycle or fabric softening cycle of a domestic washing machine, contain about 3 to 15% by weight and preferably 5. to 10% by weight of perfume. In view of their high disintegrator content, the tablets in question are sensitive to atmospheric moisture and have to be stored in a suitably protected form.

DE 39 11 363 (Baron Freytag von Loringhoven) describes a process for the production of a perfume-enriched wash liquor and a perfume addition medium suitable for this purpose. The addition medium present in the form of capsules or tablets contains the perfume together with an emulsifier in liquid form (capsules) or fixed to fillers and carriers (tablets), sodium aluminium silicates and cyclodextrins being mentioned as carriers. The perfume content of the capsules or tablets is at least 1 g for a capsule or tablet volume of more than 1 $cm^3$. Tablets or capsules containing more than 2.5 g of perfume for a volume of at least 5 $cm^3$ are preferred. For storage, tablets or capsules of the type in question have to be provided with a gas- and water-tight covering layer to protect the ingredients. The document in question does not provide any further particulars of the production of physical properties of suitable tablets.

International patent application WO 94/25563 (Henkel-Ecolab) describes a process for the production of detersive shaped bodies using the microwave technique which does not involve any high-pressure tabletting. The tablets produced by this process are distinguished by an extremely dissolving rate or disintegration rate coupled with fracture resistance without any need for a disintegrator. At the same time, they are stable in storage and can be stored without any additional precautions. Tablets with a perfume oil content of 1 to 3% by weight typical of detergents can also be produced by this process. In general, perfume oils are readily volatile and, accordingly, could even evaporate on exposure to microwave radiation. If, therefore, relatively high levels of readily volatile liquid substances are to be used, a two-component system consisting of a component produced by the microwave technique and a component containing the sensitive liquid substances is described.

Particulate additives for perfuming wash liquors and for use in detergents and processes for their production are described in International patent applications WO 97/29176 and WO 97/29177 (Procter & Gamble). According to the teaching of these documents, perfume is added to porous carrier materials (for example sucrose in admixture with zeolite X) and, finally, a coating material (carbohydrates) is applied and the required particle size distribution is established.

Earlier German patent application 197 35 783.0 (Henkel) describes highly concentrated perfume shaped bodies containing carrier material(s), 20 to 50% by weight of perfume (s) and optionally other auxiliaries and additives typical of detergents, at least 50% by weight of the shaped bodies—after subtracting the quantity of perfume—consisting of fatty acids and fatty acid salts. These perfume shaped bodies are suitable both for perfuming detergents and for perfuming laundry in a washing machine.

A process for applying perfumes to laundry in a washing machine is described in DE 195 30 999 (Henkel). In this process, a perfume-containing shaped body produced by exposure to microwave radiation is used in the final rinse cycle of a washing machine. According to the teaching of this document, the preferably spherical shaped bodies with diameters above 3 mm and bulk densities of up to 1100 g/l are produced by introducing a mixture of predominantly water-soluble carrier materials, hydrated substances, optionally surfactants and perfume into suitable molds and sintering the mixture by exposure to microwave radiation. The perfume contents of the shaped bodies are between 8 and 40% by weight and the carrier materials used include starches, silicas, silicates and disilicates, phosphates, zeolites, alkali metal salts of polycarboxylic acids, oxidation products of polyglucosans and polyaspartic acids. A crucial pre-condition of the process described in this document for producing shaped bodies is that at least partly bound water should be present in the mixture sintered by microwaving to form shaped bodies, i.e. the starting materials should be at least partly present in hydrated form.

The solutions proposed in the cited prior art require either additional barrier layers or coating layers to fix the perfume to the carrier or are not equally suitable for perfuming detergents and for direct use solely as a detergent, for example in the final rinse cycle of a washing machine. In addition, there is no reference in the cited prior art to perfume-enhancing effects on the treated laundry.

BRIEF DESCRIPTION OF THE INVENTION

The problem addressed by the present invention was to provide a process for the production of perfume shaped bodies, more particularly perfume beads, which would contain up to 15% by weight of perfume, but which nevertheless would not have to be provided with a gas-tight and water-tight coating layer or pack for storage in order to protect the ingredients or to prevent losses of perfume in storage. Another problem addressed by the present invention was to provide a perfume supply form which could both be incorporated as a compound in standard detergents and also directly used for individually choosing perfume in domestic washing processes and which would create a perfume-enhancing impression on the treated laundry.

Accordingly, the present invention relates to a process for the production of perfume shaped bodies, more particularly perfume beads, with bulk densities above 700 g/l, characterized in that a solid and substantially water-free premix of a) 65 to 95% by weight of carrier(s), b) 0 to 10% by weight of auxiliary(ies) and c) 5 to 25% by weight of perfume is subjected to granulation or press agglomeration.

DETAILED DESCRIPTION OF THE INVENTION

In the context of the present invention, the expression "substantially water-free" is understood to apply to a state in which the content of liquid water, i.e. water which is not present as water of hydration and/or water of constitution, is below 2% by weight, preferably below 1% by weight and, more preferably, even below 0.5% by weight, based on the premix. Accordingly, water can only be introduced into the process for producing the premix in chemically and/or physically bound form or as a constituent of the raw materials or compounds present as solids, but not as a liquid, solution or dispersion. The premix advantageously has a total water content of not more than 15% by weight, i.e. the water is present in chemically and/or physically bound form and not in liquid, free form. In a particularly preferred embodiment, the content of water not bound to zeolite and/or to silicates in the solid premix is no more than 10% by weight and preferably no more than 7% by weight.

The function of the carrier materials is to absorb the generally liquid components of the perfume without the particles sticking to one another. A homogeneously plasticized mixture in which the perfume is incorporated in the carrier in fine distribution is only obtained by the action of the mixing tools during the granulation step or the relatively strong shear forces in the press agglomeration step and optionally through the addition of an auxiliary or auxiliaries. This procedure has clear advantages over the conventional application of perfume to porous carrier materials, as will be explained in more detail hereinafter.

Preferred carrier materials are selected from the group of surfactants, surfactant compounds, di- and polysaccharides, silicates, zeolites, carbonates, sulfates and citrates and are used in quantities of 65 to 95% by weight and preferably in quantities of 70 to 90% by weight, based on the weight of the shaped body formed.

Any surfactants or surfactant compounds solid at temperatures of up to 40° C. may be used as surface-active carrier materials. In the context of the present invention, a "surfactant compound" is understood to be a surfactant-containing preparation which, besides typical carrier materials and auxiliaries, contains at least 20% by weight of an anionic, cationic or nonionic surfactant, based on the surfactant compound. The carrier materials typically used in surfactant compounds may advantageously be identical with the above-mentioned carrier materials used in the process according to the invention, although other carrier materials than those mentioned above may also be present as carriers in the surfactant compounds.

In preferred processes, one or more anionic surfactant compounds or anionic surfactants, more particularly soaps, is/are used as carrier materials in quantities of 65 to 95% by weight and preferably 70 to 90% by weight, based on the weight of the tablet formed. Examples of anionic surfactant compounds are alkyl benzenesulfonate (ABS) compounds on silicate or zeolite carriers with ABS contents of, for example, 10, 15, 20 or 30% by weight, fatty alcohol sulfate (FAS) compounds on silicate, zeolite or sodium sulfate carriers with active substance contents of, for example, 50 to 70, 80 or 90% by weight and anionic-surfactant-containing compounds based on sodium carbonate/sodium silicate with anionic surfactant contents above 40% by weight. Pure anionic surfactants may also be used as carriers in accordance with the present invention providing they are solid and non-hygroscopic. Soaps are particularly preferred as pure anionic surfactant carriers because, on the one hand, they remain solid up to high temperatures and, on the other hand, do not present any problems through the unwanted absorption of water. Any salts of fatty acids are used as soaps in the carrier materials for the shaped bodies according to the invention. Whereas, in principle, aluminium, alkaline earth metal and alkali metal salts of the fatty acids, for example, may be used, preferred shaped bodies are those in which the alkali metal salts and preferably the sodium salts of the fatty acids are present. Suitable fatty acids, of which the salts may be used as carrier material, are any acids obtained from vegetable or animal oils and fats. The fatty acids may be saturated or mono- to poly-unsaturated. It is of course possible to use not only "pure" fatty acids, but also the technical fatty acid mixtures obtained in the hydrolysis of fats and oils, for example palm kernel oil, coconut oil, peanut oil or rapeseed oil or bovine tallow, these mixtures being distinctly preferred from the economic point of view.

Thus, individual species or mixtures of salts of the following acids, for example, may be used in the carrier materials for the highly concentrated perfume shaped bodies according to the invention: caprylic acid, pelargonic acid, capric acid, lauric acid, myristic acid, palmitic acid, stearic acid, octadecan-12-oleic acid, arachic acid, behenic acid, lignoceric acid, cerotic acid, melissic acid, 10-undecenoic acid, petroselic acid, petroselaidic acid, oleic acid, elaidic acid, ricinoleic acid, linolaidic acid, α- and β-elaeostearic acid, gadoleic acid, erucic acid, brassidic acid. The salts of the fatty acids with an odd number of carbon atoms, for example the salts of undecanoic acid, tridecanoic acid, pentadecanoic acid, heptadecanoic acid, nonodecanoic acid, heneicosanoic acid, tricosanoic acid, pentacosanoic acid, heptacosanoic acid, may of course also be used.

In particularly preferred processes, one or more substances from the group of sodium salts of saturated or unsaturated $C_{8-24}$ fatty acids, preferably saturated or unsaturated $C_{12-18}$ fatty acids and, more preferably, saturated or unsaturated $C_{16}$ fatty acids is/are used as carrier material(s) in quantities of 75 to 95% by weight and preferably in quantities of 80 to 90% by weight, based on the weight of the shaped body formed.

Other suitable carrier materials are, for example, di- and polysaccharides, a broad range of substances from sucrose and maltose through oligosaccharides to the "traditional" polysaccharides, such as cellulose and starch and derivatives thereof, being suitable. Among the substances belonging to these sub-groups, the starches are particularly preferred.

The carriers typically used in detergents, such as silicates and zeolites, are also suitable as carriers for the purposes of the invention. The finely crystalline, synthetic zeolite containing bound water used is preferably zeolite A and/or zeolite P. Zeolite MAP® (a Crosfield product), for example, is used as zeolite P. However, zeolite X and mixtures of A, X and/or P are also suitable, for example the co-crystallizate of zeolites A and X marketed as Vegobond®AX (by Condea Augusta S.p.A.). The zeolite may be used in the form of a spray-dried powder or even in the form of an undried stabilized suspension still moist from its production. Where the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Suitable zeolites have a mean particle size of less than 10 $\mu$m (volume distribution, as measured by the Coulter Counter Method) and contain preferably 18 to 22% by weight and more preferably 20 to 22% by weight of bound water.

Other suitable carriers are layer-form sodium silicates corresponding to the general formula $NaMSi_xO_{2x+1}.yH_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x assumes the value 2 or 3. Both β- and δ-sodium disilicates $Na_2Si_2O_5.yH_2O$ are particularly preferred.

Other preferred builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. Particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-44 00 024. Compacted amorphous silicates, compounded amorphous silicates and overdried X-ray-amorphous silicates are particularly preferred.

Other suitable carrier materials are layer silicates of natural and synthetic origin. Such layer silicates are known, for example, from patent application DE-B-23 34 899, EP-A-0 026 529 and DE-A-35 26 405. Their suitability is not confined to a particular composition or structural formula. However, smectites, especially bentonites, are preferred.

Suitable layer silicates which belong to the group of water-swellable smectites are, for example, montmorillonite, hectorite or saponite. In addition, small quantities of iron may be incorporated in the crystal lattice of the layer silicates in accordance with the above formulae. By virtue of their ion-exchanging properties, the layer silicates may additionally contain hydrogen, alkali metal, alkaline earth metal ions, more particularly $Na^+$ and $Ca^{++}$. The water of hydration content is generally between 8 and 20% by weight, depending on the degree of swelling and the processing technique. Useful layer silicates are known, for example, from U.S. Pat. No. 3,966,629, EP-A-0 026 529 and EP-A-0 028 432. Layer silicates substantially freed from calcium ions and strongly coloring iron ions by an alkali treatment are preferably used.

Useful organic carriers are, for example, polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing their use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

The acids per se may also be used. Besides their efectiveness as a carrier, the acids also typically have the property of an acidifying component and, hence, also serve to establish a relatively low and mild pH value in detergents. Citric acid, succinic acid, glutaric acid, adipic acid, gluconic acid and mixtures thereof are particularly mentioned in this regard. If they are used in the premix according to the invention and are not subsequently added, these acids are preferably used in water-free form.

The premix may optionally contain auxiliaries which improve the cohesion of the carrier particles mixed with the perfume and which, under the granulation or press agglomeration conditions, envelop the solid particles and bond them to one another in such a way that the final end products are made up almost exactly of these numerous small individual particles that are held together by the auxiliary which acts as a preferably thin dividing wall between the individual particles.

These auxiliaries on the one hand facilitate the plasticization of the premix under the granulation or press agglomeration conditions and, on the other hand, develop disintegration-promoting properties during the dissolution of the perfume shaped bodies without the shaped bodies sticking to one another in transit or in storage.

Suitable auxiliaries are those from the group of polyethylene glycols, fatty alcohol ethoxylates and fatty acid alkoxylates which, in preferred processes, are used in quantities of 0 to 10% by weight, preferably in quantities of 2 to 9% by weight and more preferably in quantities of 5 to 7% by weight, based on the weight of the press granules.

The fatty acid alkoxylates optionally used may be described by general formula (I):

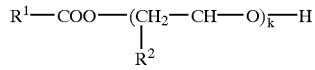

(I)

in which $R^1$ is selected from $C_{7-17}$ alkyl or alkenyl, $R^2$=—H or —$CH_3$ and k=2 to 10. Suitable fatty alcohol alkoxylates correspond to formula (II):

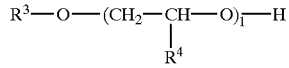

(II)

in which $R^3$ is selected from $C_{8-18}$ alkyl or alkenyl, $R^4$=—H or —$CH_3$ and I=2 to 10. In both cases, the corresponding auxiliaries may readily be produced in known manner by ethoxylation or propoxylation of fatty acids or fatty alcohols, technical mixtures of the individual species being preferred for economic reasons.

Other suitable auxiliaries are polyethylene glycols (PEGs) which may be described by general formula (III):

$$H—(O—CH_2—CH_2)_n—OH \quad (III)$$

in which the degree of polymerization n can vary from about 5 to >100,000, corresponding to molecular weights of 200 to 5,000,000 g/mol$^{-1}$. The products with molecular weights below 25,000 g/mol$^{-1}$ are actual polyethylene glycols whereas relatively high molecular weight products are often referred to in the literature as polyethylene oxides (PEOXs). The polyethylene glycols preferably used may have a linear or branched structure, linear polyethylene glycols being particularly preferred.

Particularly preferred polyethylene glycols include those with relative molecular weights of 2000 to 12,000 and advantageously around 4000, polyethylene glycols with relative molecular weights below 3500 and above 5000 being usable in particular in combination with polyethylene glycols having a relative molecular weight of around 4000 and more than 50% by weight of these combinations, based on the total quantity of polyethylene glycols, advantageously containing polyethylene glycols having a relative molecular weight of 3500 to 5000. However, other suitable binders are polyethylene glycols which, basically, are present as liquids at room temperature/1 bar pressure, above all polyethylene glycol with a relative molecular weight of 200, 400 and 600.

According to the invention, a preferred process is characterized in that one or more substances from the group of polyethylene glycols with molecular weights of 2 to 15 kgmol$^{-}$ and preferably in the range from 4 to 10 kgmol$^{-}$ is/are used as auxiliaries in quantities of 0 to 10% by weight, preferably 2 to 9% by weight and more preferably 5 to 7% by weight, based on the weight of the shaped body formed.

The perfume oils or perfumes used in the process according to the may be individual perfume compounds, for example synthetic products of the ester, ether, aldehyde, ketone, alcohol and hydrocarbon type. Examples of perfume compounds of the ester type are benzyl acetate, phenoxyethyl isobutyrate, p-tert.butyl cyclohexyl acetate, linalyl acetate, dimethyl benzyl carbinyl acetate (DMBCA), phenyl ethyl acetate, benzyl acetate, ethyl methyl phenyl glycinate, allyl cyclohexyl propionate, styrallyl propionate, benzyl salicylate, cyclohexyl salicylate, floramate, melusate and jasmecyclate. The ethers include, for example, benzyl ethyl ether and Ambroxan; the aldehydes include, for example, linear alkanals containing 8 to 18 carbon atoms, citral, citronellal, citronellyloxy acetaldehyde, cyclamen aldehyde, lilial and bourgeonal; the ketones include, for example, ionones, α-isomethyl ionone and methyl cedryl ketone; the alcohols include anethol, citronellol, eugenol, geraniol, linalool, phenyl ethyl alcohol and terpineol while the hydrocarbons include, above all, terpenes, such as limonene and pinene. However, mixtures of different perfumes which together produce an attractive perfume note are preferably used.

Perfume oils such as these may also contain natural perfume mixtures obtainable from vegetable sources, for example pine, citrus, jasmine, patchouli, rose or ylang-ylang oil. Also suitable are clary oil camomile oil, clove oil, melissa oil, mint oil, cinnamon leaf oil, lime blossom oil, juniper berry oil, vetiver oil, olibanum oil, galbanum oil and labdanum oil and orange blossom oil, neroli oil, orange peel oil and sandalwood oil.

After the individual constituents have been combined, the substantially water-free premix is subjected to granulation or press agglomeration. In granulation, the premix is compacted and homogenized by the rotating mixing tools and granulated to form perfume shaped bodies, more particularly perfume beads. The granulation of the substantially water-free premix gives perfume beads with a broader particle size distribution (coarse and fine fractions) so that the press agglomeration variant is preferred to the granulation variant.

In the press agglomeration process, the premix is compacted and plasticized under pressure and under the effect of shear forces, homogenized and then discharged from the machines via a forming/shaping stage. Technically the most important press agglomeration processes are extrusion, roller compacting, pelleting and tabletting. Preferred press agglomeration processes for the purposes of the present invention are extrusion, roller compacting and pelleting.

In one preferred embodiment of the invention, the premix is delivered, preferably continuously, to a planetary roll extruder or to a twin-screw extruder with co-rotating or contra-rotating screws, of which the barrel and the extrusion/granulation head can be heated to the predetermined extrusion temperature. Under the shearing effect of the extruder screws, the premix is compacted under a pressure of preferably at least 25 bar or—with extremely high throughputs—even lower, depending on the apparatus used, plasticized, extruded in the form of fine strands through the multiple-bore extrusion die in the extruder head and, finally, size-reduced by means of a rotating cutting blade, preferably into substantially spherical or cylindrical granules. The bore diameter of the multiple-bore extrusion die and the length to which the strands are cut are adapted to the selected granule size. In this embodiment, granules are produced in a substantially uniformly predeterminable particle size, the absolute particle sizes being adaptable to the particular application envisaged. In general, particle diameters of up to at most 0.8 cm are preferred. Important embodiments provide for the production of uniform granules in the millimeter range, for example in the range from 0.5 to 5 mm and more particularly in the range from about 0.8 to 3 mm. In one important embodiment, the length-to-diameter ratio of the primary granules is in the range from about 1:1 to about 3:1. In another preferred embodiment, the still plastic primary granules are subjected to another shaping process step in which edges present on the crude extrudate are rounded off so that, ultimately, spherical or substantially spherical extrudate granules can be obtained. If desired, small quantities of drying powder, for example zeolite powder, such as zeolite NaA powder, may be used in this step. This shaping step may be carried out in commercially available spheronizers. It is important in this regard to ensure that only small quantities of fines are formed in this stage. According to the present invention, however, there is no need for drying, which is described as a preferred embodiment in the prior art documents cited above, because the process according to the invention is carried out in the substantial absence of water, i.e. without the addition of free non-bound water.

Alternatively, extrusion/compression steps may also be carried out in low-pressure extruders, in a Kahl press (Amandus Kahl) or in a so-called Bextruder.

As in the extrusion process, it is also preferred in the other production processes to subject the primary granules/compactates formed to another shaping process step, more particularly spheronizing, so that, ultimately, spherical or substantially spherical (bead-like) granules can be obtained.

By virtue of the fact that the process according to the invention is carried out in the substantial absence of water, i.e. except for the water present as "impurity" in the solid raw materials used, an ecologically valuable process is also provided because elimination of the need for a subsequent drying step not only saves energy, emissions which occur predominantly in conventional drying techniques can also be avoided. In addition, the absence of subsequent drying steps enables the perfumes to be incorporated in the premix and thus provides for the production of the perfume shaped bodies, more particularly perfume beads, according to the invention.

In another preferred embodiment of the present invention, the process according to the invention is carried out by roller compacting. In this variant, the perfume-containing, solid and substantially water-free premix is introduced between two rollers—either smooth or provided with depressions of defined shape—and rolled under pressure between the two rollers to form a sheet-like compactate. The rollers exert a high linear pressure on the premix and may be additionally heated or cooled as required. Where smooth rollers are used, smooth untextured compactate sheets are obtained. By contrast, where textured rollers are used, correspondingly textured compactates, in which for example certain shapes can be imposed in advance on the subsequent perfume shaped bodies, can be produced. The sheet-like compactate is then broken up into smaller pieces by a chopping and size-reducing process and can thus be processed to granules which can be further refined and, more particularly, converted into a substantially spherical shape by further surface treatment processes known per se.

In another preferred embodiment of the present invention, the process according to the invention is carried out by pelleting. In this process, the perfume-containing, solid and substantially water-free premix is applied to a perforated surface and is forced through the perforations and at the same time plasticized by a pressure roller. In conventional pellet presses, the premix is compacted under pressure, plasticized, forced through a perforated surface in the form of fine strands by means of a rotating roller and, finally, is size-reduced to granules by a cutting unit. The pressure roller and the perforated die may assume many different forms. For example, flat perforated plates are used, as are concave or convex ring dies through which the material is pressed by one or more pressure rollers. In perforated-plate presses, the pressure rollers may also be conical in shape. In ring die presses, the dies and pressure rollers may rotate in the same direction or in opposite directions. A press suitable for carrying out the process according to the invention is described, for example, in DE-OS 38 16 842 (Schlüter GmbH). The ring die press disclosed in this document consists of a rotating ring die permeated by pressure bores and at least one pressure roller operatively connected to the inner surface thereof which presses the material delivered to the die space through the pressure bores into a discharge unit. The ring die and pressure roller are designed to be driven in the same direction which reduces the shear load applied to the premix and hence the increase in temperature which it undergoes. However, the pelleting process may of course also be carried out with heatable or coolable rollers to enable the premix to be adjusted to a required temperature.

Another press agglomeration process which may be used in accordance with the invention is tabletting. In view of the size of the shaped bodies produced, it may be appropriate in the tabletting variant to add conventional disintegration aids, for example cellulose and cellulose derivatives or crosslinked PVP, in addition to the binder described above to facilitate the disintegration of the shaped bodies in the wash liquor.

The perfume shaped bodies produced in accordance with the invention may be additionally sprayed with perfume in a subsequent step. The conventional perfuming variant, i.e. powdering and spraying with perfume, can also be carried out with the perfume shaped bodies produced in accordance with the invention.

Advantageously, at least 30% by weight, preferably at least 40% by weight and more preferably at least 50% by weight of the total perfume present in the perfume shaped bodies produced in accordance with the invention are introduced into the detergent by the production process according to the invention, i.e. incorporated in the granules or press agglomerates, while the remaining 70% by weight, preferably 60% by weight and more preferably 50% by weight of the total perfume present may be sprayed onto or otherwise applied to the granules or press agglomerates which may optionally be surface-treated.

By dividing the total perfume content of the detergents into perfume present in the granules or press agglomerates and perfume adhering to the granules or press agglomerates, it is possible to achieve a number of product features which are only possible through the process according to the invention. For example, the total perfume content of the detergents can be divided into two portions x and y, portion x consisting of firmly adhering perfume oils, i.e. less volatile perfume oils, and portion y consisting of more volatile perfume oils.

Now, it is possible to produce detergents where the percentage of perfume introduced into the detergent through the granules or press agglomerates is mainly made up of firmly adhering perfumes. In this way, firmly adhering perfumes which are intended to perfume the treated articles, more especially textiles, are "retained" in the product and thus develop their effect primarily on the treated laundry. By contrast, the more readily volatile perfumes contribute towards more intensive perfuming of the detergents per se. In this way, it is also possible to produce detergents which, as detergents, have a perfume that differs from the perfume of the treated articles. There are virtually no limits in this regard to the creativity of perfumists because almost limitless possibilities for perfuming the detergents and—through the detergents—the articles treated with them exist on the one hand through the choice of the perfumes and on the other hand through the choice of the method used to incorporate them in the detergents.

The principle described above can of course also be reversed by incorporating the more readily volatile perfumes in the granules or press agglomerates and spraying the less volatile firmly adhering perfumes onto the detergents. In this way, the loss of the more readily volatile perfumes from the pack in storage and in transit is minimized while the perfume characteristic of the detergents is determined by the more firmly adhering perfumes.

The general description of the perfumes suitable for use in accordance with the invention (see above) represented the various classes of perfumes in general terms. In order to be noticeable, a perfume has to be volatile, its molecular weight being an important factor along with the nature of the functional groups and the structure of the chemical compound. Thus, most perfumes have molecular weights of up to about 200 dalton, molecular weights of 300 dalton and higher being more the exception. In view of the differences in volatility of perfumes, the odor of a perfume or fragrance composed of several perfumes changes during the evaporation process, the odor impressions being divided into the top note, the middle note or body and the end note or dry out. Since odor perception is also based to a large extent on odor intensity, the top note of a perfume or fragrance does not consist solely of readily volatile compounds whereas the end note or dry out consists largely of less volatile, i.e. firmly adhering, perfumes. In the composition of perfumes, more readily volatile perfumes may be fixed, for example, to certain "fixatives", which prevents them from vaporizing too rapidly. The above-described embodiment of the present invention, in which the more readily volatile perfumes or fragrances are incorporated in the press agglomerate, is one such method of fixing a perfume. Accordingly, in the following classification of perfumes into "readily volatile" and "firmly adhering" perfumes, nothing is said about the odor impression or about whether the corresponding perfume is perceived as a top note or middle note.

Firmly adhering perfumes suitable for use in accordance with the present invention are, for example, the essential oils, such as angelica root oil, aniseed oil, arnica flowers oil, basil oil, bay oil, bergamot oil, champax blossom oil, silver fir oil, silver fir cone oil, elemi oil, eucalyptus oil, fennel oil, pine needle oil, galbanum oil, geranium oil, ginger grass oil, guaiac wood oil, Indian wood oil, helichrysum oil, ho oil, ginger oil, iris oil, cajeput oil, sweet flag oil, camomile oil, camphor oil, canaga oil, cardamom oil, cassia oil, Scotch fir oil, copaiba balsam oil, coriander oil, spearmint oil, caraway oil, cumin oil, lavender oil, lemon grass oil, limette oil, mandarin oil, melissa oil, amber seed oil, myrrh oil, clove oil, neroli oil, niaouli oil, olibanum oil, orange oil, origanum oil, palmarosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, thuja oil, thyme oil, verbena oil, vetiver oil, juniper berry oil, wormwood oil, wintergreen oil, ylang-ylang oil, ysop oil, cinnamon oil, cinnamon leaf oil, citronella oil, citrus oil and cypress oil.

However, relatively high-boiling or solid perfumes of natural or synthetic origin may also be used in accordance with the invention as firmly adhering perfumes or perfume mixtures. These compounds include those mentioned in the following and mixtures thereof: ambrettolide, α-amyl cinnamaldehyde, anethole, anisaldehyde, anisalcohol, anisole, methyl anthranilate, acetophenone, benzyl acetone, benzaldehyde, ethyl benzoate, benzophenone, benzyl alcohol, benzyl acetate, benzyl benzoate, benzyl formate, benzyl valerate, borneol, bornyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formiate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarin, p-methoxyacetophenone, methyl-n-amyl ketone, methyl anthranilic acid methyl ester, p-methyl acetophenone, methyl chavicol, p-methyl quinoline, methyl-β-naphthyl ketone, methyl-n-nonyl acetaldehyde, methyl-n-nonyl ketone, muskone, β-naphthol ethyl ether, β-naphthol methyl ether, nerol, nitrobenzene, n-nonyl aldehyde, nonyl alcohol, n-octyl aldehyde, p-oxyacetophenone, pentadecanolide, β-phenyl ethyl alcohol, phenyl acetaldehyde dimethyl acetal, phenyl acetic acid, pulegone, safrol, isoamyl salicylate, methyl salicylate, hexyl salicylate, cyclohexyl salicylate, santalol, scatol, terpineol, thymene, thymol, γ-undecalactone, vanillin, veratrum aldehyde, cinnamaldehyde, cinnamyl alcohol, cinnamic acid, ethyl cinnamate, benzyl cinnamate.

The more readily volatile perfumes include, in particular, the relatively low-boiling perfumes of natural or synthetic origin which may be used either individually or in the form of mixtures. Examples of more readily volatile perfumes are alkyl isothiocyanates (alkyl mustard oils), butanedione, limonene, linalool, linalyl acetate and propionate, menthol, menthone, methyl-n-heptenone, phellandrene, phenyl acetaldehyde, terpinyl acetate, citral, citronellal.

In addition to the above-mentioned constituents of the substantially water-free premix, other ingredients may be introduced into the process according to the invention in small quantities of 1 to 10% by weight, preferably 1 to 5% by weight and more preferably 1 to 2% by weight, based on the premix. These substances may be used to color the perfume beads or to provide them with certain performance properties. However, it is also possible to add detergent ingredients of which the incorporation is normally attended by process-related disadvantages. Thus, substances normally used in small quantities, such as optical brighteners, phosphonates, dye transfer inhibitors, etc., are subsequently incorporated. By introducing these substances into the process according to the invention, perfume shaped bodies, more particularly perfume beads, which contain other active substances and which may therefore be introduced into detergents as a perfume and active compound, are obtained. Moeover, an additional process step in the production of detergents is saved in this way.

In other embodiments, the present invention relates to the use of perfume shaped bodies, more particularly perfume beads, with bulk densities above 700 g/l produced by the process according to the invention by granulation or press agglomeration of a solid and substantially water-free premix of a) 65 to 95% by weight of carrier(s), b) 0 to 10% by weight of auxiliary(ies) and c) 5 to 25% by weight of perfume for perfuming detergents.

In another embodiment, therefore, the present invention relates to detergents containing perfume shaped bodies, more particularly perfume beads, produced in accordance with the invention in quantities of more than 0.5% by weight, preferably in quantities of more than 1% by weight and more preferably in quantities of more than 2% by weight, based on the detergent.

The perfume shaped bodies, more particularly perfume beads, produced in accordance with the invention may be incorporated in standard detergents where they are used as described above for perfuming the detergents. However, the perfume shaped bodies, more particularly perfume beads, produced in accordance with the invention may also be offered separately as part of a building block system whereby the consumer acquires a perfume-free basic detergent and can then add various perfume shaped bodies, more particularly perfume beads, in order in this way to be able to chose from the range of perfume variants, depending on the nature of the treated laundry.

If the possibility described above of incorporating small quantities of other substances in the premix is used, detergents consisting of at least two compounds can be produced with the aid of the perfume shaped bodies, more particularly perfume beads, produced in accordance with the invention, the perfume shaped bodies, more particularly perfume beads, being one of those compounds. In this case, the constituents of the detergents which are not present at all or are not present in sufficient quantities in the perfume shaped bodies may be mixed with the perfume shaped bodies, more particularly perfume beads, in the form of one or more compounds. In another embodiment, therefore, the present invention relates to detergents produced by mixing at least two compounds, at least one compound consisting of perfume shaped bodies, more particularly perfume beads, with bulk densities above 700 g/l which have been produced by granulation or press agglomeration of a solid and substantially water-free premix of 65 to 95% by weight of carrier(s), 0 to 10% by weight of auxiliary(ies), 5 to 25% by weight of perfume and 1 to 10% by weight, preferably 1 to 5% by weight and more preferably 1 to 2% by weight of one or more substances from the group of dyes, optical brighteners, complexing agents, dye transfer inhibitors, enzymes and soil-release polymers.

In another preferred embodiment, the present invention relates to a process for applying perfumes to laundry in a washing machine by adding perfume-containing shaped bodies, more particularly perfume beads, in the rinse cycle, characterized in that shaped bodies with bulk densities above 700 g/l produced by the process according to the invention by granulation or press agglomeration of a solid and substantially water-premix of a) 65 to 95% by weight of carrier(s), b) 0 to 10% by weight of auxiliary(ies) and c) 5 to 25% by weight of perfume are added to the wet laundry in the wash or rinse cycle of an automatic washing process.

EXAMPLES

A free-flowing premix was prepared by mixing the formulation ingredients listed below in a Lödige mixer and was then compacted and plasticized in an extruder.

TABLE 1

Perfume beads premix (composition in % by weight)

| | DUP 1 | DUP 2 | DUP 3 | DUP 4 | DUP 5 | DUP 6 |
|---|---|---|---|---|---|---|
| Na salt of a fatty acid (80% palm/ 20% coconut) | 85.7 | 88.0 | 88.0 | — | — | — |
| Zeolite X | — | — | — | 10.0 | — | — |
| Na silicate, modulus 2.4 | — | — | — | — | 10.0 | — |
| PEG 4000 | 4.8 | — | 4.0 | 7.0 | 7.0 | 6.0 |
| Spray-dried granules 1 | — | — | — | 73.0 | — | — |
| Spray-dried granules 2 | — | — | — | — | 73.0 | — |
| Spray-dried granules 3 | — | — | — | — | — | 79.0 |
| Perfume oil | 9.5 | 12.0 | 8.0 | 10.0 | 10.0 | 15.0 |

Composition of the spray-dried granules (surfactant compounds produced by spray drying)

| Spray-dried granules 1: | |
|---|---|
| 26.17% by weight | Na $C_{9-13}$ alkyl benzenesulfonate |
| 4.00% by weight | sodium carbonate |
| 55.63% by weight | zeolite 4A |
| 0.70% by weight | salts from solution |
| 13.00% by weight | water |
| 0.50% by weight | sodium hydroxide |

| Spray-dried granules 2: | |
|---|---|
| 30.00% by weight | Na $C_{9-13}$ alkyl benzenesulfonate |
| 4.25% by weight | sodium carbonate |
| 53.73% by weight | sodium silicate, modulus 2.4 |
| 0.85% by weight | salts from solution |
| 11.17% by weight | water |

-continued

| Spray-dried granules 3: | |
|---|---|
| 10.00% by weight | Na $C_{9-13}$ alkyl benzenesulfonate |
| 1.65% by weight | $C_{16-18}$ fatty alcohol + 5 EO |
| 58.75% by weight | zeolite 4A |
| 4.50% by weight | acrylic acid/maleic acid copolymer, Na salt |
| 1.00% by weight | 1-hydroxyethane-1,1-diphosphonic acid (HEDP) |
| 3.00% by weight | sodium sulfate |
| 0.85% by weight | sodium hydroxide |
| 5.00% by weight | optical brightener |
| 0.50% by weight | salts from solution |
| 14.75% by weight | water |

After leaving the mixer, the free-flowing premix had a bulk density of about 400 g/l and was introduced into a Lihotzky twin-screw extruder in which it was plasticized and extruded under pressure.

The plasticized premix left the extruder under a pressure of 85 bar through a multiple-bore die with bore diameters of 0.5, 0.7, 0.85 and 1.2 mm. The extruded strands were cut to a length-to-diameter ratio of about 1 by a rotating blade and rounded in a Marumerizer®. After the fine particles (<0.4 mm) and the coarse particles (>2.0 mm) had been removed by sieving, the extrudates had the physical properties set out in Table 2.

TABLE 2

Physical properties of the perfume beads

| | DUP 1 | DUP 2 | DUP 3 | DUP 4 | DUP 5 | DUP 6 |
|---|---|---|---|---|---|---|
| Bulk density | 760 | 750 | 770 | 800 | 790 | 805 |
| diameter [mm] | 0.5 | 0.5 | 0.5/ 0.7/ 0.85/ 1.2 | 0.7/ 0.85/ 1.2/ 1.4 | 0.7/ 0.85/ 1.2 | 0.85/ 1.2/ 1.4 |
| Granule diameter [mm] | | | | | | |

The perfume beads DUP 1 to DUP 6 produced in accordance with the invention were compared with extrudates of similar composition where the particular perfume oils had been conventionally sprayed onto the extruded and rounded particles that had been powdered with fine-particle zeolite.

In addition, an extrudate which contained part of the perfume and which, in addition, was sprayed with the rest of the perfume was produced in order to demonstrate the variant according to the invention where the perfumes are split. This extrudate was compared with a reference extrudate where all the perfume had been applied by spraying.

The composition of the perfume oils used in the individual perfume beads is shown in Table 3. The perfuming of the product and of treated textiles (cotton) was evaluated by perfumists as a subjective odor impression. The figures in the evaluation Table (Table 4) indicate the number of perfumists which classified the particular products or the textiles treated with them as "fairly strongly perfuming". Since a different number of perfumists was present in the various perfume tests, the values in the "perfumists" columns do not always add up to the same figure. Accordingly, the first block of the first column (product) should be interpreted to mean that 5 out 7 perfumists evaluated the extrudates produced in accordance with the invention as fairly strongly perfuming. The results of the perfume tests are set out in Table 4.

TABLE 3

| Composition of the perfume oils [% by weight] | |
|---|---|
| Perfume oil DUP 1, 3, 5 | |
| Bergamot oil | 15.0 |
| Dihydromyrcenol | 20.0 |
| Citrus oil messina | 7.5 |
| Mandarin oil | 2.5 |
| Orange oil sweet | 5.0 |
| Allyl amyl glycolate | 2.0 |
| Cyclovertal | 0.5 |
| Lavandin oil grosso | 2.5 |
| Clary oil | 1.0 |
| Lilial | 2.0 |
| β-Damascone | 0.1 |
| Geranium oil bourbon | 3.0 |
| Hedione | 5.0 |
| Cyclohexyl salicylate | 4.0 |
| Vertofix Coeur | 10.0 |
| Iso-E-super | 5.0 |
| Ambroxan | 1.6 |
| Ethylene brassylate | 10.0 |
| Evernyl | 1.0 |
| Perfume oil DUP 2, 4, 6 | |
| Phenyl ethyl alcohol | 52.0 |
| Dimethyl benzyl carbinyl acetate | 2.5 |
| Iraldein gamma | 5.0 |
| Phenyl acetic acid | 0.5 |
| Geranyl acetate | 2.0 |
| Benzyl acetate | 30.0 |
| Rose oxide L 10% in DPG | 2.5 |
| Romilate | 20.0 |
| Irotyl | 0.5 |
| Cyclohexyl salicylate | 20.0 |
| Floramate | 10.0 |

TABLE 4

| Perfume enhancement (intensity preference) | Perfumists (intensity preference) | | |
|---|---|---|---|
| | Product | Damp laundry | Dry laundry |
| 0.4% perfume oil via DUP 3 (0.5 mm) | 4 | 5 | 3 |
| 0.4% perfume oil (sprayed-on) | 1 | 1 | 1 |
| 0.4% perfume oil via DUP 3 + 0.1% perfume oil (sprayed on) | 4 | 5 | 4 |
| 0.5% perfume oil (sprayed-on) | 2 | 1 | 2 |
| 0.2% perfume oil via DUP 1 + 0.2% perfume oil via DUP 3 | 4 | 6 | 4 |
| 0.4% perfume oil (sprayed-on) | 2 | 0 | 2 |
| 0.4% perfume oil via DUP 6 | 4 | 5 | 4 |
| 0.4% perfume oil (sprayed-on) | 1 | 0 | 1 |

In another series of tests, two products were perfumed using perfume beads while a third product was conventionally perfumed by spraying on the same amount of perfume. The samples were evaluated by six different perfumists on a ranking scale of 1 ("perfumes best") to 3 ("worst perfuming productt"). The results of these three-product tests are set out in Tables 5 and 6 where the values in each of the penultimate columns represent the sum of the six individual values. Accordingly, this column represents the averaged ranking of the evaluations of the six perfumists, the smaller figures—in contrast to the above Tables—characterizing the better perfume results (ranking). The last column indicates the average position.

TABLE 5

| Perfume enhancement on damp laundry (intensity preference) | Perfumists (intensity preference) | | | | | | | |
|---|---|---|---|---|---|---|---|---|
| | Damp laundry | | | | | | Σ | Place |
| 0.4% perfume oil (sprayed-on) | 3 | 3 | 2 | 1 | 3 | 2 | 14 | 3 |
| 0.4% perfume oil via DUP 3 (0.5 mm) | 1 | 1 | 1 | 3 | 2 | 1 | 9 | 1 |
| 0.4% perfume oil via DUP 4 (1.2 mm) | 2 | 2 | 3 | 2 | 1 | 3 | 13 | 2 |
| 0.4% perfume oil (sprayed-on) | 2 | 3 | 3 | 3 | 3 | 2 | 16 | 3 |
| 0.2% perfume oil via DUP 3 (0.5 mm) + 0.2% perfume oil via DUP 5 (1.2 mm) | 1 | 1 | 2 | 1 | 1 | 1 | 7 | 1 |
| 0.2% perfume oil via DUP 4 (1.2 mm) + 0.2% perfume oiI via DUP 5 (1.2 mm) | 3 | 2 | 1 | 2 | 2 | 3 | 13 | 2 |
| 0.4% perfume oil (sprayed-on) | 3 | 2 | 3 | 3 | 3 | 3 | 17 | 3 |
| 0.2% perfume oil via DUP 4 (1.4 mm) | 2 | 3 | 1 | 1 | 2 | 2 | 11 | 2 |
| 0.2% perfume via DUP 6 (1.4 mm) | 1 | 1 | 2 | 2 | 1 | 1 | 8 | 1 |

TABLE 6

| Perfume enhancement on dry laundry (intensity preference) | Perfumists (intensity preference) | | | | | | | |
|---|---|---|---|---|---|---|---|---|
| | Dry laundry | | | | | | Σ | Place |
| 0.4% perfume oil (sprayed-on) | 3 | 3 | 2 | 3 | 2 | 2 | 15 | 3 |
| 0.4% perfume oil via DUP 2 (0.5 mm) | 1 | 1 | 1 | 1 | 3 | 1 | 8 | 1 |
| 0.4% perfume oil via DUP 4 (0.5 mm) | 2 | 2 | 3 | 2 | 1 | 3 | 13 | 2 |
| 0.4% perfume oil (sprayed-on) | 3 | 2 | 3 | 3 | 2 | 3 | 16 | 3 |
| 0.2% perfume oil via DUP 3 (0.5 mm) + 0.2% perfume oil via DUP 5 (1.2 mm) | 1 | 1 | 2 | 1 | 3 | 1 | 9 | 1 |
| 0.2% perfume oil via DUP 4 (1.2 mm) + 0.2% perfume oil via DUP 5 (1.2 mm) | 2 | 3 | 1 | 2 | 1 | 2 | 13 | 2 |

TABLE 6-continued

Perfume enhancement on dry laundry (intensity preference)

| | Perfumists (intensity preference) | | | | | | | |
|---|---|---|---|---|---|---|---|---|
| | Dry laundry | | | | | | Σ | Place |
| 0.4% perfume oil (sprayed-on) | 3 | 3 | 2 | 3 | 3 | 3 | 17 | 3 |
| 0.2% perfume oil via DUP 4 (1.4 mm) | 2 | 1 | 3 | 1 | 2 | 2 | 11 | 2 |
| 0.2% perfume oil via DUP 6 (1.4 mm) | 1 | 2 | 1 | 2 | 1 | 1 | 8 | 1 |

What is claimed is:

1. A process for the production of perfume shaped bodies with a bulk density above 700 g/l, which comprises preparing a solid, substantially water-free premix comprising a) 65 to 95% by weight of a carrier, b) 0 to 10% by weight of auxiliaries and c) 5 to 25% by weight of perfume; and shaping the premix by a method selected from the group consisting of granulation, press agglomeration and combinations thereof, wherein the carrier comprises at least one member selected from the group consisting of anionic surfactant compounds and anionic surfactants, in an amount of 75 to 95% by weight based on the weight of the shaped body.

2. The process as claimed in claim 1 wherein the solid, substantially water-free premix is subjected to press agglomeration.

3. The process as claimed in claim 1 wherein the premix has a total water content of not more than 15% by weight, this water not being present in free form and the content of water not bound to zeolite and silicates being no more than 10% by weight.

4. The process as claimed in claim 1 wherein the carrier comprises at least one substance selected from the group consisting of surfactants, surfactant compounds, disaccharides, polysaccharides, silicates, zeolites, carbonates, sulfates and citrates.

5. The process as claimed in claim 1 wherein the carrier comprises at least one substance selected from the group consisting of sodium salts of saturated $C_{8-24}$ fatty acids and sodium salts of unsaturated $C_{8-24}$ fatty acids, in an amount of 75 to 95% by weight based on the weight of the shaped body.

6. The process as claimed in claim 1 wherein the shaped body comprises at least one substance selected from the group consisting of polyethylene glycols, fatty alcohol alkoxylates and fatty acid alkoxylates as a coating material in an amount of 1 to 10% by weight, based on the weight of the shaped body.

7. The process as claimed in claim 6, wherein the coating material comprises polyethylene glycol with a molecular weight of 2 to 15 $kgmole^{-1}$.

8. A detergent composition comprising the perfume shaped bodies produced by the process claimed in claim 1.

9. The detergent composition comprising perfume shaped bodies of claim 8, in an amount of more than 0.5% by weight, based on the detergent composition.

10. A detergent composition produced by mixing at least two compounds, at least one compound comprising perfume shaped bodies, with a bulk density above 700 g/l, produced by a method selected from the group consisting of granulation, press agglomeration and combinations thereof of a solid and substantially water-free premix comprising a) 65 to 95% by weight of carrier, b) 0 to 10% by weight of auxiliaries and c) 5 to 25% by weight of perfume and d) 1 to 10% by weight, of at least one substances selected from the group consisting of dyes, optical brighteners, complexing agents, dye transfer inhibitors, enzymes and soil-release polymers.

11. A process for applying perfumes to laundry in a washing machine which comprises; adding perfume shaped bodies, the perfume shaped bodies, having a bulk density above 700 g/l, produced by a method selected from the group consisting of granulation, press agglomeration and combinations thereof of a solid and substantially water-free premix comprising a) 65 to 95% by weight of carrier, b) 0 to 10% by weight of auxiliaries and c) 5 to 25% by weight of perfume to the wet laundry in the wash or rinse cycle of an automatic washing process.

12. The process of claim 2 wherein the premix has a total water content of not more than 15% by weight, this water not being present in free form and the content of water not bound to zeolite and silicates being no more than 10% by weight.

13. The process of claim 2 wherein the carrier comprises at least one substance selected from the group consisting of surfactants, surfactant compounds, disaccharides, polysaccharides, silicates, zeolites, carbonates, sulfates and citrates.

14. The process of claim 3 wherein the carrier comprises at least one substance selected from the group consisting of surfactants, surfactant compounds, disaccharides, polysaccharides, silicates, zeolites, carbonates, sulfates and citrates.

15. The process of claim 2 wherein the carrier comprises at least one member selected from the group consisting of anionic surfactant compounds and anionic surfactants, in an amount of 75 to 95% by weight based on the weight of the shaped body.

16. The process of claim 3 wherein the carrier comprises at least one member selected from the group consisting of anionic surfactant compounds and anionic surfactants, in an amount of 75 to 95% by weight based on the weight of the shaped body.

17. The process of claim 4 wherein the carrier comprises at least one member selected from the group consisting of anionic surfactant compounds and anionic surfactants, in an amount of 75 to 95% by weight based on the weight of the shaped body.

18. The process of claim 2 wherein the carrier comprises at least one substance selected from the group consisting of sodium salts of saturated C8–24 fatty acids and sodium salts of unsaturated C8–24 fatty acids, in an amount of 75 to 95% by weight based on the weight of the shaped body.

19. The process of claim 3 wherein the carrier comprises at least one substance selected from the group consisting of sodium salts of saturated C8–24 fatty acids and sodium salts of unsaturated C8–24 fatty acids, in an amount of 75 to 95% by weight based on the weight of the shaped body.

* * * * *